United States Patent [19]

Zacharin

[11] 4,393,780

[45] Jul. 19, 1983

[54] OMNI DIRECTIONAL FUZE

[75] Inventor: Alexey T. Zacharin, Parsippany, N.J.

[73] Assignee: The United States of America as represented by the Secretary of the Army, Washington, D.C.

[21] Appl. No.: 293,739

[22] Filed: Aug. 17, 1981

[51] Int. Cl.[3] ..... F42C 1/06; F42C 9/02; F42B 23/26

[52] U.S. Cl. ..... 102/255; 102/256; 102/273; 102/274

[58] Field of Search ..... 102/254–259, 102/246–248, 273, 274, 221, 222

[56] References Cited

U.S. PATENT DOCUMENTS

| | | | |
|---|---|---|---|
| 3,316,841 | 5/1967 | McFann et al. | 102/255 |
| 3,351,017 | 11/1967 | Myers | 102/254 X |
| 3,382,803 | 5/1968 | Swallow et al. | 102/254 |
| 3,457,382 | 7/1969 | Boswell | 102/273 X |
| 3,601,060 | 8/1971 | Thuen | 102/257 |
| 3,730,100 | 5/1973 | Hadfield | 102/258 |
| 3,759,181 | 9/1973 | Mellen | 102/274 X |
| 3,786,750 | 1/1974 | Zacharin | 102/257 X |
| 4,091,735 | 5/1978 | Martwick et al. | 102/274 X |
| 4,306,501 | 12/1981 | Eshleman | 102/273 |

FOREIGN PATENT DOCUMENTS

| | | | |
|---|---|---|---|
| 342502 | 12/1959 | Switzerland | 102/255 |

*Primary Examiner*—David H. Brown

*Attorney, Agent, or Firm*—Robert P. Gibson; Anthony T. Lane; A. Victor Erkkila

[57] ABSTRACT

A fuze has a firing pin slidably mounted in a frame. A detonator mounted in the frame is operable to slide into alignment with the pin. An impact sensor can engage and restrain the pin. This sensor is pivotally mounted in the frame and is operable to disengage the pin in response to deceleration of the frame in excess of a predetermined magnitude.

13 Claims, 8 Drawing Figures

OMNI DIRECTIONAL FUZE

GOVERNMENT INTEREST

The invention described herein may be manufactured, used and licensed by or for the government for governmental purposes without the payment to me of any royalties thereon.

BACKGROUND OF THE INVENTION

The present invention relates to fuzes and, in particular, to fuzes having an inertial sensor for triggering a detonator upon impact regardless of the direction of the impact.

It is known to include safety devices in a fuze to prevent unintended detonation. These known devices include safety pins and various other mechanisms requiring an operator to perform a manual operation before arming the device. In such safety mechanisms, a high degree of reliability is important so that the weapon is not fired accidentally or through the failure of a single component.

A significant problem in designing fuzes is allowing for a large variation of target impacts. A problem with the prior art is that the known fuzes required considerable impulse on impact before detonation. A well-designed fuze can reliably detonate a main charge notwithstanding a large variation in the magnitude or direction of the impact. While many known fuzes have been designed to solve this problem, recent miniaturization of components has drastically reduced available space. Accordingly, new fuze designs are required to satisfy the desired sensitivity, safety and other factors important for reliably triggering an explosive.

Accordingly, there is a need for a simple fuze which can be miniaturized and has good sensitivity to an impact from any direction but yet has safety features for avoiding unintended detonation.

SUMMARY OF THE INVENTION

In accordance with the illustrative embodiment demonstrating features and advantages of the present invention, there is provided a fuze including a firing pin slidably mounted in a frame. A detonator mounted in the frame is operable to slide into alignment with the pin. An impact sensor can engage and restrain the pin. This sensor is pivotally mounted in the frame and is operable to disengage the pin in response to deceleration of the frame in excess of a predetermined magnitude.

By employing such apparatus, a relatively compact, simple and yet sensitive fuze is provided that can detonate a weapon in response to an impact applied from any direction. In a preferred embodiment, the impact sensor is a weight pivoted in a socket and normally positioned to hold a spherical bearing against the tapered front of a firing pin. An impulse applied to the frame supporting the sensor causes it to be displaced thereby allowing the spherical bearing to disengage the firing pin.

Preferably, the firing pin initially is not aligned with a detonator carried in a slider. The slider is arranged to require two physical events before its associated spring can drive the detonator into alignment with the firing pin. Firstly, the slider is sized to project outside of the frame when it moves from a safe to an armed position. Accordingly, when the weapon is loaded into a gun barrel or is awaiting ejection from a warhead tube, the slider cannot move since there is no clearance. Secondly, a safety rod must be drawn from the slider. In one embodiment, the safety is drawn by forces generated by a stabilizer connected to the safety. Thus, the weapon is safe until after launch at least, when the stabilizer is operable.

Also, in the preferred embodiment slider motion is regulated by a horological timing mechanism to ensure that even after the projectile is launched that a minimum amount of time elapses before the weapon is armed. This feature prevents firing from a force caused by removing the safety itself. It is also preferred that the slider in its safe position have a cavity aligned with the firing pin so that if it falsely triggers, it will be captured in the cavity, thereby locking the fuze and preventing any future firing.

It is preferred that the impact sensor be in the form of a weighted rod, whose pivot point is axially adjustable to allow adjustment of the fuze sensitivity. Also, in this embodiment, the slider will have a support arm that encircles and prevents movement of the impact sensor when the slider is in its safe position. When the slider is moved to the armed position, the slider disengages the impact sensor to allow triggering.

BRIEF DESCRIPTION OF THE DRAWINGS

The above brief description as well as other objects, features and advantages of the present invention will be more fully appreciated by reference to the following detailed description of a presently preferred but nonetheless illustrative embodiment in accordance with the present invention when taken in conjunction with the accompanying drawings wherein.

DETAILED DESCRIPTION OF THE PREFERRED EMBODIMENT

Figure 1:
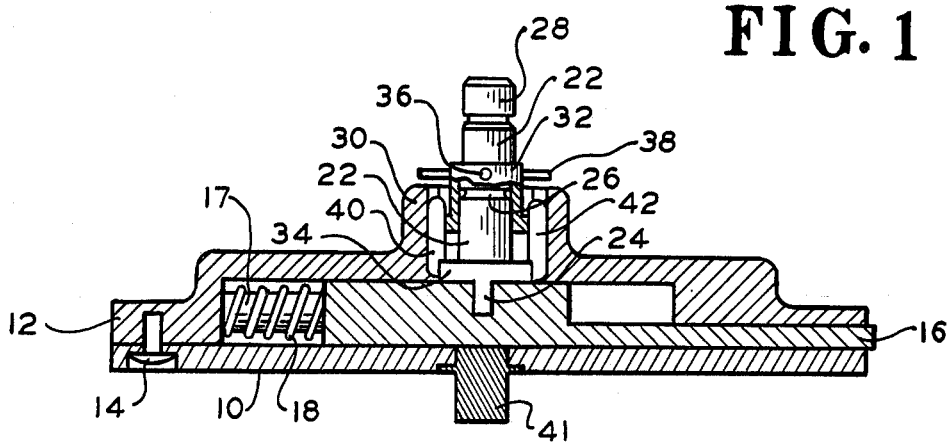
FIG. 1 is an elevational view of a fuze according to the principles of the present invention.
Figure 2:
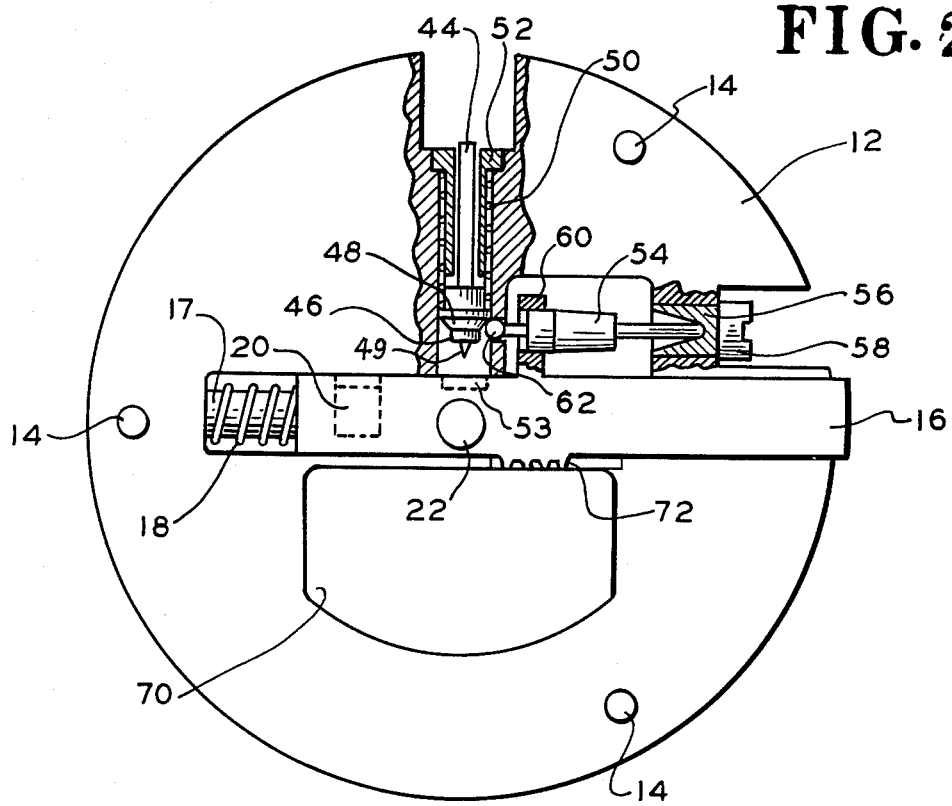
FIG. 2 is a top view of the fuze of FIG. 1 with its cover removed.

Referring to FIGS. 1 and 2, a fuze is shown as a frame having a base plate 10 secured with a cover 12 by means of screws 14. Frame 10, 12 is generally shaped as a circular housing having in cover 12 a radial slot containing slider 16. Slider 16 is a rectangular bar coupled on one end by a means for outwardly urging the slider, shown as compression spring 18. Spring 18 encircles a cylindrical tab 17 coaxially mounted on the end of slider 16. The other end of slider 16 has a reduced thickness allowing it to fit through a spacing between cover 12 and base plate 10. Accordingly, should slider 16 be outwardly urged by spring 18, the slider would project beyond the perimeter of frame 10, 12. Slider 16 has a cavity containing a detonator 20 (shown in phantom in FIG. 2).

Figure 3A:
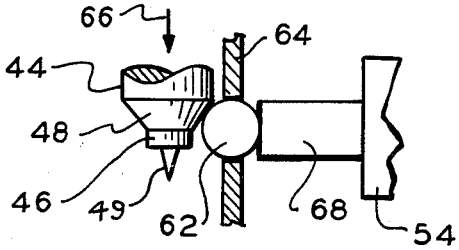
FIG. 3A is a detailed view of the junction of the pin and impact sensor of FIG. 2.
Figure 3B:
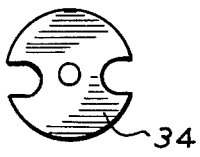
FIG. 3B is a detailed view of the flange of the safety of FIG. 1.

A safety is shown herein as rod 22 having a reduced diameter tip 24 which engages a corresponding hole in slider 16, preventing its movement. The outer portions of safety 22 have a circumferential groove 26 and a fastening screwhead 28 for attaching a stabilizer 80. Safety 22 is mounted within a concentric bushing 32 in a collar 30 of cover 12. Bushing 32 acts as a stop when safety 22 is drawn outwardly and flange 34 of safety 22 engages the bushing. In that position, locking spring 38, which is mounted in and around bushing 32, can engage groove 26, thereby locking the safety 22 in the armed position. A frangible shaft 36 is mounted through matching apertures in safety 22 and bushing 32 to prevent safety 22 from disengaging slider 16. Semicircular notches cut into the sides of flange 34, bushing 32 and collar 30 hold matching keyway pins 40 and 42. Pins 40 and 42 prevent safety 22 from rotating and thereby inadvertently shearing pin 36. The notches in flange 34 of safety 22 for receiving keyway pins 40 and 42 are shown separately in FIG. 3B.

Mounted in a bore in cover 12 is firing pin 44, having a cylindrical head 46 with a frustro-conical portion 48. Mounted on the inner face of head 46 is point 49. A means for urging pin 44 towards slider 16 is shown as compression spring 50, contained between the flange of sleeve 52 and the rear face of head 46. It will be observed in FIG. 2 that pin 44 aligns with cavity 53 in slider 16 when it is in its safe position. This cavity would trap the head of pin 44 should the pin incorrectly fire when slider 16 is in its safe position, preventing any further use of the fuze.

As explained further hereinafter, detonator 20 can move into alignment with pin 44. When so aligned, detonator 20 overlays explosive lead 41 which then can become part of the explosive train from detonator 20. Lead 41 is concentrically mounted in base plate 10.

An impact sensor 54 is in the shape of a rod having a mediate, weighted section. Sensor 54 is pivotally mounted in a socket 56 which is axially adjustable by means of screwhead 58, allowing sensor 54 to be moved away or toward firing pin 44. Slider 16, being in its safe position, has an arm 60 containing a hole 61 for receiving the weighted, mediate portion of sensor 54 and preventing it from moving. As shown in further detail in FIG. 3A, a rounded member 62 is located in the aperture of a wall 64 separating the compartments in cover 12 containing firing pin 44 and impact sensor 54. It will be observed that member 62 is a metal ball sized to engage the frustro-conical surface of firing pin 44 so that the pin cannot move in the direction shown by arrow 66. It will also be noticed that the size of the diameter of tip 68 of sensor 54 determines to what extent sensor 54 must move to release ball 62. Accordingly, depending upon the desired sensitivity, the diameter of tip 68 can be made smaller (or larger) to decrease (or increase) the amount of movement required before firing pin 44 is released.

Mounted on cover 12 is a horological timing mechanism 70 (FIG. 2) which has a gear mechanism (not shown) engaging a rack 72 of slider 16. Timing device 70 can be any one of several timing devices that cause the motion of slider 16 to be kept at a predetermined velocity.

Figure 7:
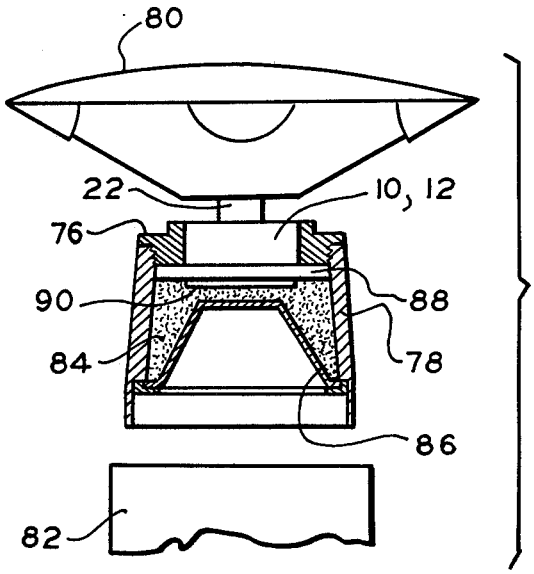
FIG. 7 is a partially sectioned elevational view of the fuze of FIG. 1 installed in a stabilized submunition casing employing a shaped charge.

Referring to FIG. 7, fuze frame 10, 12 is shown mounted within a threaded collar 76 in submunition casing 78. Safety 22 of the fuze is shown attached to stabilizer 80 with fastening screwhead 28 noted previously. Stabilizer 80 is a well-known collapsible device that can fold so that the casing 78 can fit into main casing 82. Main casing 82 may be part of a rocket fired from an aircraft. The rocket has a device (not shown) to eject submunition casing 78 over the target, thus allowing the submunition casing 78 to fall downwardly approximately in the orientation shown due to the stabilizing influence of stablizer 80. Also mounted within casing 78 beneath fuze 10, 12 is a conventional booster 88 overlaying a wave shaper 90. The main charge 84 within casing 78 is shaped and fitted with a frustro-conical liner 86.

Figure 4:
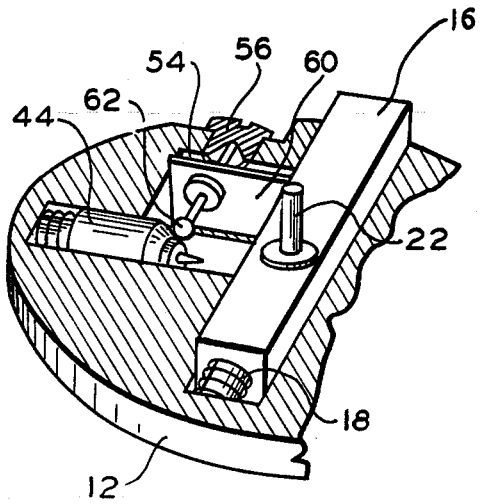
FIG. 4 is a perspective view of the fuze of FIG. 1 in its safe condition.
Figure 5:
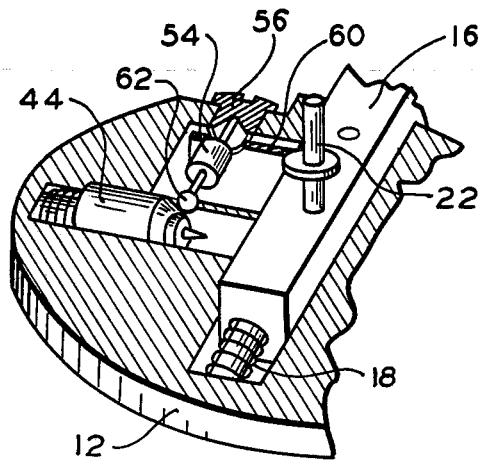
FIG. 5 is a perspective view of the fuze of FIG. 4 in an armed condition.

In operation, ejection of the submunition casing 78 causes stabilizer 80 to unfold and apply a tension force to safety 22. As a result, frangible pin 36 (FIG. 1) is sheared and safety 22 is drawn outwardly until flange 34 engages bushing 32 and groove 26 reaches retaining spring 38 which locks safety 22 in the armed position. The initial release of safety 22 is illustrated by the changed conditions from FIG. 4 to FIG. 5, showing slider 16 being driven outwardly by compression spring 18. This motion is only possible because the fuze has been withdrawn from warhead tube 82 so that slider 16 (FIG. 2) can move outwardly. The speed of outward travel of slider 16 is regulated in a conventional manner by horological timing device 70 which engages and restrains the teeth of rack 72.

Accordingly, when slider 16 reaches the position shown in FIG. 5, detonator 20 (FIG. 2) is aligned with firing pin 44. Also as slider 16 moves, arm 60 moves from a position where it holds the weighted part of sensor 54 to a position adjacent socket 56. In this position, arm 60 no longer restrains sensor 54 which is now freed to pivot about socket 56. This completes the preliminary motions of the fuze and places it in an armed condition. At this time, the fuze and its shaped charge 84 is descending toward a target.

Figure 6:
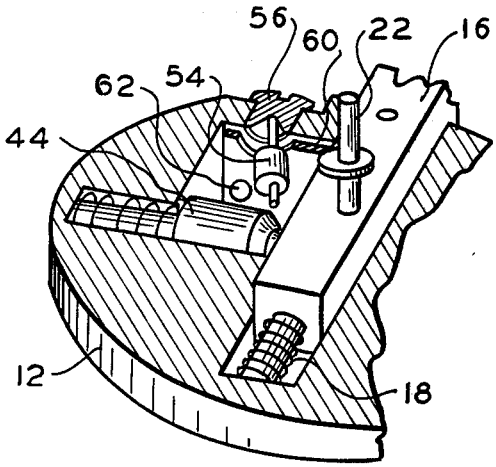
FIG. 6 is a perspective view of the fuze of FIG. 5 showing the fuze at triggering.

Upon impact with the ground or the target, frame 10, 12 experiences an impulse which produces an inertial force on sensor 54. As a result, sensor 54 moves away from its engagement with ball 62 as shown in FIG. 6. Consequently, firing pin 44 is free to move toward slider 16 and to strike and ignite detonator 20 within slider 16. The detonator initiates an explosive train which propagates through explosive lead 41, booster 88, around wave shaper 90, finally firing main charge 84. Frustro-conical liner 86 acts as a conventional shaped charge liner, causing a lethal jet.

As previously mentioned, the foregoing sequence can be aborted should firing pin 44 be released early. Should this happen, firing pin 44 would be driven into cavity 53 of slider 16, thereby locking the mechanism. Therefore, the fuze could not fire and would require manual disassembly and resetting before it would again be operable.

It is to be appreciated that various modifications may be implemented with respect to the above described preferred embodiment. For example, the various components previously illustrated may be formed of various metals or other materials depending upon the desired strength, size, weight, rigidity, speed, etc. Furthermore, while the connection between the impact sensor and firing pin is disclosed as a ball trapped in a wall between these two devices, in certain embodiments the ball may be eliminated or an optional, intermediate component substituted therefor. It is also expected that the relevant orientation between impact sensor, firing pin, detonator and slider can be changed depending upon the physical requirements of the weapon. Also, various illustrated components can be combined into a simplified, unitary structure to improve strength and rigidity. In addition, the disclosed fuze can be applied to various types of weapons that ought to be fired in response to an impact.

Obviously, many modifications and variations of the present invention are possible in light of the above teachings. It is therefore to be understood that within the scope of the appended claims, the invention may be practiced otherwise than as specifically described.

I claim:

1. A fuze comprising:

a frame;

a firing pin slidably mounted in said frame;

a slider supporting a detonator, for moving said detonator into alignment with said pin;

an impact sensor for engaging and restraining said pin, said sensor being pivotally mounted in said frame;

said slider having a safe position and having an arm sized to hold said sensor when said slider is in said safe position, said sensor being free to pivot and to disengage said pin in response to deceleration of said frame in excess of a predetermined magnitude when said slider has moved said detonator into alignment with said pin.

2. A fuze according to claim 1 further comprising:

a rounded member detachably mounted between said pin and said impact sensor.

3. A fuze according to claim 2 wherein said frame includes:

a wall located between said pin and said impact sensor, said wall having an aperture sized to receive said rounded member.

4. A fuze according to claim 3 further comprising:

a safety slidably mounted in said frame for engaging and restraining said slider, said safety being operable to disengage said slider in response to a pulling force.

5. A fuze according to claim 4 further comprising:

a frangible shaft, said safety and frame having holes sized and positioned to hold different respective ends of said frangible shaft.

6. A fuze according to claim 1 further comprising:

a socket mounted in said frame to the side of said pin, said sensor having a pivotal end mounted in said socket to allow said sensor to pivot with two degrees of freedom.

7. A fuze according to claim 6 wherein said socket is axially adjustable to alter its spacing from said pin.

8. A fuze according to claim 7 further comprising:

a horological timing mechanism mounted in said frame for regulating outward motion of said slider.

9. A fuze according to claim 8 wherein said slider has a cavity that aligns with said pin when said slider is in its safe position.

10. A fuze according to claim 9 wherein said frame is sized to fit within a given casing provided said slider is in its safe position, said fuze including means for outwardly urging said slider.

11. A fuze according to claim 10 further comprising means for urging said pin toward said slider.

12. A fuze according to claim 10 further comprising:

a safety slidably mounted in said frame for engaging and restraining said slider, said safety being operable to disengage said slider in response to a pulling force; and a stabilizer attached to said safety and shaped to inflate and apply a shock to said safety in response to air ramming said stabilizer.

13. A fuze according to claim 12 further comprising:

a rounded member detachably mounted between said pin and said impact sensor, said frame including a wall located between said pin and said impact sensor, said wall having an aperture sized to receive said rounded member; and a frangible shaft, said safety and frame having holes sized and positioned to hold different respective ends of said frangible shaft.

* * * * *